US006360576B1

(12) United States Patent
Plata et al.

(10) Patent No.: US 6,360,576 B1
(45) **Date of Patent: *Mar. 26, 2002**

(54) PROCESS FOR EXTRUDING A METAL SECTION

(75) Inventors: Miroslaw Plata, Vétroz; Martin Bolliger, Venthône; Grégoire Arnold, Muraz, all of (CH); Pius Schwellinger, Tengen (DE)

(73) Assignee: Alusuisse Technology & Management AG, Neuhausen am Rheinfall (CH)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/297,618

(22) PCT Filed: Oct. 20, 1997

(86) PCT No.: PCT/CH97/00391

§ 371 Date: May 4, 1999

§ 102(e) Date: May 4, 1999

(87) PCT Pub. No.: WO98/19803

PCT Pub. Date: May 14, 1998

(30) Foreign Application Priority Data

Nov. 4, 1996 (EP) ..... 96810732

(51) Int. Cl.[7] ..... B21C 33/00
(52) U.S. Cl. ..... 72/270; 72/253.1; 72/257
(58) Field of Search ..... 72/253.1, 257, 72/258, 268, 270, 271, 286; 164/113, 312

(56) References Cited

U.S. PATENT DOCUMENTS

| | | | | | |
|---|---|---|---|---|---|
| 4,208,898 | A | * | 6/1980 | Ames et al. | 72/258 |
| 4,308,742 | A | * | 1/1982 | Harrison et al. | 72/271 |
| 4,393,917 | A | * | 7/1983 | Fuchs, Jr. | 164/476 |
| 4,688,624 | A | * | 8/1987 | Suzuki et al. | 164/440 |
| 4,758,398 | A | * | 7/1988 | Sparapany et al. | 72/271 |
| 4,934,445 | A | | 6/1990 | Plata et al. | |
| 5,031,436 | A | * | 7/1991 | Visser | 72/257 |
| 5,040,589 | A | * | 8/1991 | Bradley et al. | 164/113 |
| 5,197,319 | A | * | 3/1993 | Beekel et al. | 72/268 |
| 5,473,925 | A | * | 12/1995 | Yano | 72/271 |
| 5,551,997 | A | * | 9/1996 | Marder et al. | 148/437 |
| 5,680,894 | A | * | 10/1997 | Kilbert | 164/312 |
| 5,716,467 | A | * | 2/1998 | Marder et al. | 148/549 |
| 5,780,063 | A | * | 7/1998 | Friedrichs | 72/258 |
| 5,787,585 | A | * | 8/1998 | Rashid | 72/612 |
| 5,802,905 | A | * | 9/1998 | Biswas et al. | 72/257 |
| 5,915,455 | A | * | 6/1999 | Kittilsen et al. | 164/440 |
| 5,927,130 | A | * | 7/1999 | Watson et al. | 72/258 |

FOREIGN PATENT DOCUMENTS

| | | | | |
|---|---|---|---|---|
| DE | 25 14 386 | | 10/1975 | |
| EP | 0 042 814 | | 12/1981 | |
| EP | 210568 | * | 2/1987 | 72/253.1 |
| EP | 0 343 103 | | 11/1989 | |
| EP | 0 241 193 | | 6/1991 | |
| JP | 56-148411 | | 11/1981 | |
| JP | 1-309717 | | 12/1989 | |
| JP | 2-137613 | * | 5/1990 | 72/253.1 |
| JP | 4-066219 | | 3/1992 | |
| SU | 11 28 998 | | 12/1984 | |
| WO | WO 87/06624 | | 11/1987 | |
| WO | WO 91/02098 | | 2/1991 | |
| WO | 91/18689 | * | 12/1991 | 72/258 |
| WO | WO 92/01821 | | 2/1992 | |
| WO | WO 92/18763 | | 10/1992 | |

* cited by examiner

*Primary Examiner*—Ed Tolan
(74) *Attorney, Agent, or Firm*—Cohen, Pontani, Lieberman & Pavane

(57) ABSTRACT

In a process for the manufacture of a shaped bar consisting of an at least partially metallic material, a preform is shaped to form the shaped bar in the partially solid/partially liquid state and the shaped bar in the partially solid/partially liquid state is guided through a chilled mould for setting. An optionally heatable preform chamber is provided for receiving the preform, an optionally heatable forming chamber is connected to the preform chamber for shaping the preform to form the shaped bar, and a chilled mold is connected to the forming chamber for the setting of the shaped bar. A die can optionally be arranged immediately downstream of the mould for the final shaping process and the device.

33 Claims, 3 Drawing Sheets

PROCESS FOR EXTRUDING A METAL SECTION

BACKGROUND OF THE INVENTION

1. Field of the Invention

The invention relates to a process for the manufacture of a shaped bar. The invention also covers a device suitable for carrying out the process, as well as use of the process and use of the device.

2. Discussion of the Prior Art

One known process for the manufacture of metal profiles is extrusion. However, with current extrusion technology, it is very difficult to manufacture large Aluminium alloy profiles with a width of more than approximately 700 mm. Another disadvantage consists in that it is very difficult to obtain profile wall thicknesses of less than approximately 2 mm. However, in view of weight and cost savings, it would be highly desirable to reduce the wall thicknesses of profiles, i.e. to achieve all thicknesses of less than 1 mm while still observing the usual geometric profile tolerances.

The limited extrusion force and the limited possibilities of obtaining uniform metal distribution with respect to, temperature and flow rate are the essential factors preventing the manufacture of extremely thin-walled profiles using current extrusion technology.

However, in current extrusion technology, certain limits exist even in the manufacture of profiles of medium or small width, with respect to the materials than can be processed and the cross-sectional dimensions to be produced. For example, it is virtually impossible or very difficult to press hard Aluminium alloys with the extrusion forces normally used in conventional extruders. This limitation applies in particular to the manufacture of hollow profiles, particularly multi-compartment hollow profiles. The resulting slow extrusion rate has a negative effect on production costs. In addition, the dimensional tolerances are often insufficient and there is often poor mental distribution, noticeable above all through insufficient mould filling in shaped parts with small metal crossectional dimensions.

The extrusion of particle-reinforced composite materials consisting of a metal matrix with particles of fibres of non-metallic, high-melting materials dispersed therein leads to comparable problems to the above-mentioned processing of hard alloys. The manufacture of these so-called Metal Matrix Composites is described in detail in WOA-87/06624, WOA-91/02098 and WOA-92/01821. The particles to be introduced into the metal matrix are first essentially introduced homogeneously in an alloy melt and the molten composite material is then case, e.g. by continuous casting, into the format suitable for further processing by extrusion of rolling.

A process of the type mentioned at the outset is known from JP-A-04066219. The aim of the invention is therefore to provide a process of the type mentioned at the outset and a device suitable for carrying out the process, by means of which hard alloys and composite materials of all types can be processed into high-quality products in a cost-effective manner. Another aim is the economical manufacture of extremely thinwalled large profiles and/or large profiles of extreme width. In addition, it should be possible to modify existing extrusion installations in a simple and cost-effective manner.

Pursuant to the present invention, preform is usually inserted in the form of billet into a preform chamber which will be described in more detail hereinbelow. The preform and the preform chamber therefore correspond to the extrusion billet and the container in extrusion.

By virtue of the fact that the preform is shaped in the partially solid/partially liquid state according to the invention, materials which were virtually impossible to manufacture of could only be manufactured in a very uneconomical manner by conventional extrusion can be processed into profiles with a constant extrusion force. As a result of the low extrusion forces required, comparable profile dimensions can be pressed in smaller installations than in the case of conventional manufacturing methods, this being advantageous from the point of view of production costs.

One essential advantage of the process according to the invention is that hard alloys and composite materials can be processed into profiles with metallurgical properties that cannot be obtained by conventional extrusion.

Wider profiles with smaller profile wall thicknesses than in possible with current extrusion technology can also be manufactured by the process according to the invention.

The central idea underlying the process according to the invention consists in bringing the preform so close to the final cross section with the lowest possible extrusion force that the final shaping of the cross section of the shaped bar can also be carried out with low extrusion force by means of a die. This is achieved by the shaping in the partially solid/partially liquid state according to the invention.

Compared to the use of conventional perfectly set extrusion billets, the use of preforms in the partially solid/partially liquid state has the advantage that shaping can be carried out with substantially lower extrusion force. If the liquid phase fraction is kept low compared to the solid phase fraction, sufficiently rapid setting can also be achieved in thick-walled profile regions.

As the pressure applied to the preform, i.e. the extrusion force, cannot be increased as desired, e.g. as a result of the high container temperature of up to 600° C. required in the case of special additives, in an advantageous development of the process according to the invention, the preform is pressed to form the shaped bar with the aid of a tensile force acting on the shaped bar.

The degree of shaping upon the transition of the preform to the shaped bar in the partially solid/partially liquid state is preferably at least 50%, preferably at least 80%. The degree of shaping refers here to the reduction in the cross section during the shaping of the preform to form the shaped bar.

If the shaped bar has to have a high surface quality and/or high dimensional tolerance, the shaped bar can be guided through a die immediately after it emerges from the mould for the final shaping of the cross section of the shaped bar. This final shaping of the cross section of the shaped bar is advantageously carried out with shaping of no more than 15%, preferably no more than 10%.

After it emerges from the mould or the die, the shaped bar is preferably cooled by the complete evaporation of a coolant sprayed on to the shaped bar. Cooling with complete evaporation of the coolant prevents liquid coolant from being able to flow back in the direction of the hot metal possibly still in the partially liquid state. By virtue of this measure, the cooling means can be arranged as close as possible to the site of the desired cooling, i.e. as close as possible to the mould or the die.

The liquid phase fraction in the preform during the shaping thereof depends on the nature of the material to be processed. In general, this fraction is no more than 70%, and is preferably approximately 20 to 50%. In principle, any materials in which a partially solid/partially liquid state can be set within a sufficiently broad temperature interval for practical purposes can be used for the preforms. Examples of suitable materials are:

- alloys, in particular aluminium and magnesium alloys in the thixotropic state, with different solid/liquid fractions, e.g. hard alloys of the AlMg or MgAl type,
- alloys based on magnesium or copper in the thixotropic state, with different solid/liquid fractions, and
- alloys based on aluminium or magnesium with metallic or non-metallic fractions of high-melting particles and/or fibres (Metal Matrix Composites).

Aluminium and magnesium alloys in particular are suitable as the metal matrix. Its basic properties, such as mechanical strength and elongation can be achieved in a known manner by means of the various types of alloy. The non-metallic additives can have an advantageous effect, inter alia, on hardness, rigidity and other properties. Preferred non-metallic additives are ceramic materials such as metal oxides, metal nitrides and metal carbides. Examples of materials of this kind are silicon carbide, aluminium oxide, boron carbide, silicon nitride and boron nitride.

In principle, profiles can be manufactured from composite materials in such a manner that the preform already contains all of the materials in the desired form. However, with the process according to the invention, a filler material can also be added to the preform in the partially solid/partially liquid state before it enters the mould. This filler material can be added indifferent forms and in different states of aggregation. E.g. the filler material can be supplied continuously to the preform in solid form as wire, fibres or powder. Wires, e.g. in the form of reinforcements can remain in the profile. However, a material which melts in the partially liquid/partially solid range, where it then alloys or triggers a chemical reaction can also be added in the form of wire. The filler material can also be added in the liquid state or in the gaseous state.

One essential advantage of the process according to the invention over conventional extrusion also consists in that preforms can be composed of cross-sectionally different material regions. E.g., the edge zone or even internal parts of a profile can be provided with different mechanical properties from those of the matrix, such as higher hardness, rigidity, abrasion resistance and the like.

Preforms with cross-sectionally different material regions can be processed in that the preform is guided through a heating zone before it is shaped to form the shaped bar and is set to a uniform solid/liquid ratio over the entire cross section of the shaped bar in the heating zone. To this end, a cross-sectionally different temperature profile can be set in the heating zone as a function of cross-sectionally different material regions.

A device suitable for carrying out the process according to the invention includes an optionally heatable preform chamber for receiving the preform, an optionally heatable forming chamber connected to the preform chamber for shaping the preform to form the shaped bar, and a chilled mould connected to the forming chamber for the setting of the shaped bar, wherein a die can optionally also be arranged immediately downstream of the mould for the final shaping of the cross section of the shaped bar.

An extractor means can be arranged downstream of the downstream of the device according to the invention in order to apply a tensile force to the shaped bar and therefore to assist the entire extrusion process. The extractor means can include grippers and/or drive rollers.

The wall of the forming chamber preferably passes over into the wall of the mould with a constant curvature, i.e. the cross section of the preform being shaped to form the shaped bar decreases continuously.

Heating lines are arranged in the preform chamber and/or in the forming chamber in order to produce or maintain the partially solid/partially liquid state of the preform. In addition, an intermediate layer of a heat-insulating material is advantageously arranged between the generally heated forming chamber and the chilled mould.

A heating means is advantageously arranged between the preform chamber and the forming chamber. This heating means preferably has individually heatable flow channels for the preform.

In a preferred embodiment of the device according to the invention, the heating means consists of at least two disc-shaped heating elements arranged side by side and provided with integrated heating conductors, the heating elements being individually controllable.

A direct cooling means is provided for further cooling of the shaped bar emerging from the mould or the die. For the aforementioned reasons, a cooling means with complete evaporation of the coolant applied to the shaped bar is preferred.

A particularly preferred application of the process and device according to the invention consists of the manufacture of profiles with cross-sectionally different material regions.

BRIEF DESCRIPTION OF THE DRAWINGS

Further advantages, features and details of the invention will be clear from the following description of preferred embodiments and with reference to the accompanying diagrammatic drawings, in which.

DETAILED DESCRIPTION OF THE PREFERRED EMBODIMENTS

Figure 1:
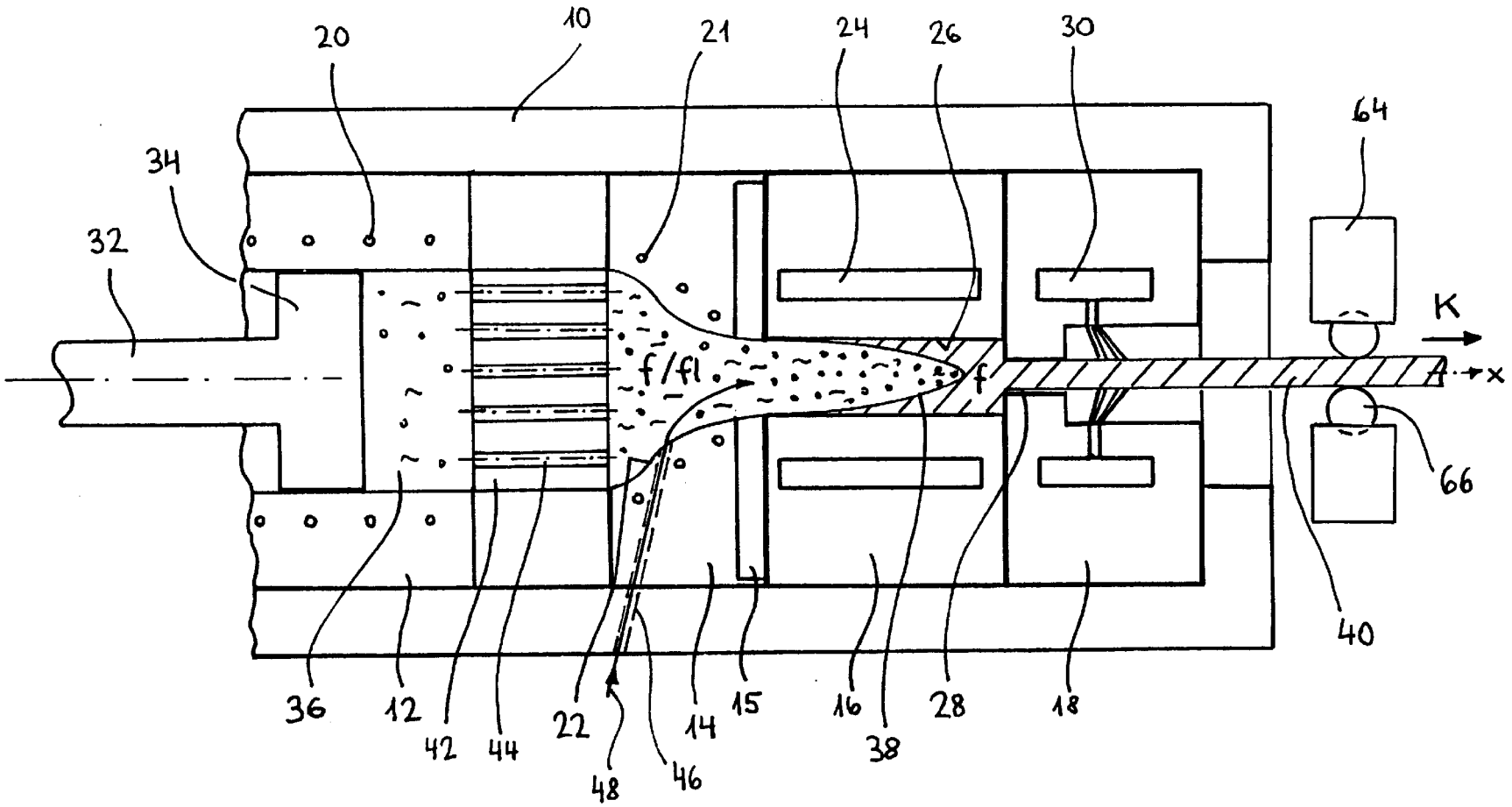
FIG. 1 is a diagrammatic representation of a device for the manufacture of a shaped bar.

According to FIG. 1, an extrusion installation (not shown in the drawings for the sake of clarity) for the manufacture of metal profiles has a container 10 with a preform chamber 12 for receiving preforms 36. A heating means 42, a forming chamber 14, a mould 16 and a die 18 are connected to the preform chamber 12 in the aforesaid order as viewed in the extrusion direction x.

The preform chamber 12 and the forming chamber 14 are provided with heating lines 20, 21 for heating the two chambers 12, 14. The heating means 42, has a plurality of individually heatable flow channels 44 arranged parallel to the extrusion direction x for heating the preform 36 to a state of equilibrium with respect to the desired solid/liquid ratio. An intermediate layer 15 of a heat-insulating material is arranged between the forming chamber 14 and the mould 16.

The mould 16 is provided with a first cooling means 24 for indirect cooling of the metal bar setting by contact with the mould wall 26. A second cooling means 30 is arranged within the die 18 and serves for direct cooling of the shaped bar 40 emerging from the die by the direct application of coolant thereto.

As in the case of extrusion, the profile chamber 14 can be provided with a corresponding mandrel insert for the manufacture of hollow profiles.

An inlet channel 46 for supplying a filler material 48 into the partially solid/partially liquid region opens into the forming chamber 14. This filler material 48 can be supplied in solid form as wire, fibres or powder, in the liquid state, or even in the gaseous state.

An extractor means 64 is arranged at the outlet end of the die 18. A tensile force K is applied in the extrusion direction x to the shaped bar 40 emerging from the die in 18 by means of drive rollers 66. This measure removes pressure from the extrusion process so that an acceptable extrusion rate can be achieved even at elevated extrusion temperatures.

The method of operation of the arrangement described hereinbefore will now be described in more detail with reference to the diagrammatic representation illustrated in the drawings. For the sake of completeness, it should also be mentioned here that the arrangement according to the invention is designed in such a manner that it can be installed in a problem-free manner in a conventional extrusion installation.

The preform 36 in the form of a metal billet which is usually already preheated is introduced into the preform chamber 12 and is heated further by means of the heating lines 20. The preform 36 is driven in the extrusion direction x by means of a punch 32 with a dummy block 34 and is converted into the desired partially solid/partially liquid state within the heating means 42. The main part of the shaping of the preform 36 is effected in the forming chamber 14, the wall 22 of the forming chamber 14 continuously moving further towards the inlet opening of the mould 16.

The setting of the metal bar from the partially solid/partially liquid state f/f1 to the solid state f is effected within the mould 16, the design of which essentially corresponds to that of a conventional continuous casting mould, along a setting front 38 departing from the mould wall 26. Immediately after it emerges from the mould 16, the set metal bar enters the die 18, where final shaping is effected in a die opening 28.

The shape of the shaped bar 40 within the mould 16 is ideally already almost such that only a small change in the cross section or slight shaping is still effected in the die 18, i.e. the die 18 serves principally for the formation of a high-quality profile surface and the production of a dimensionally accurate profile cross section. The direct application of coolant from the cooling means 30 to the shaped bar 40 emerging from the die 18 ensures that any partially liquid fractions still remaining in the interior of the profile are set completely. After it emerges from the die 18, the set shaped bar 40 is gripped by the drive rollers 66 of the extractor means 64 and is drawn out of the die 18 in the extrusion direction x.

In addition to pure metal alloys, metals with metallic or non-metallic additives having a higher melting point than the basic metal are also suitable as materials for the preform 36 to be supplied to the preform chamber 12. These materials include, e.g. particle-reinforced or fibre-reinforced materials with an aluminium matrix, i.e. so-called Metal Matrix composites. Other suitable materials are alloys, in particular aluminum alloys, in the thixotropic state, as well as non-thixotropic hard alloys, e.g. AlMg alloys, in particular alloys with eutectic solidification.

Figure 2:
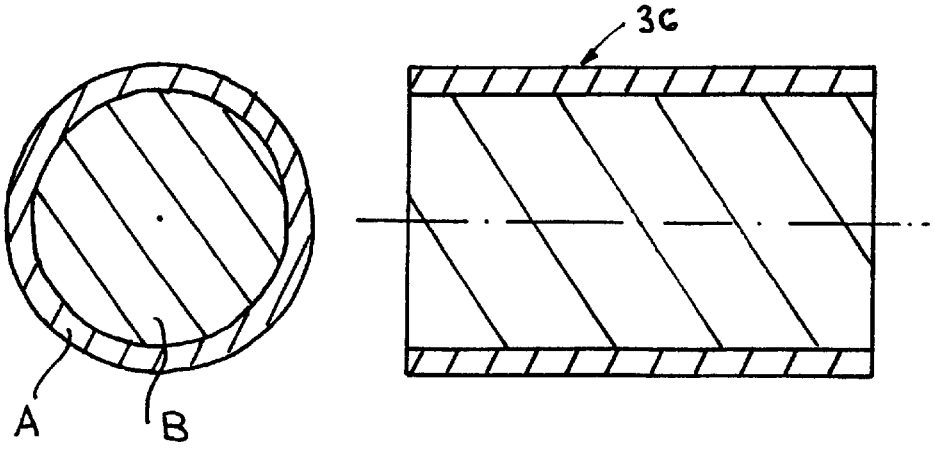
FIGS. 2 to 4 are longitudinal and cross sections through different preforms with cross-sectionally different material regions.
Figure 3:
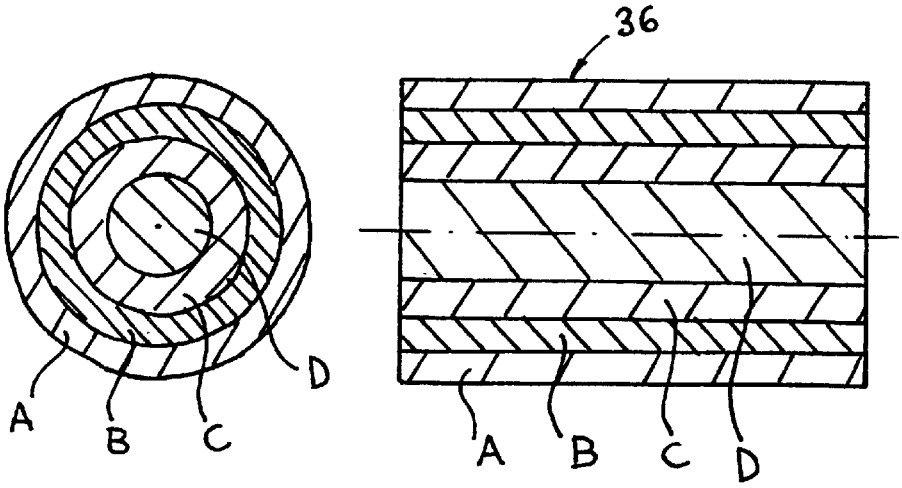
Figure 4:
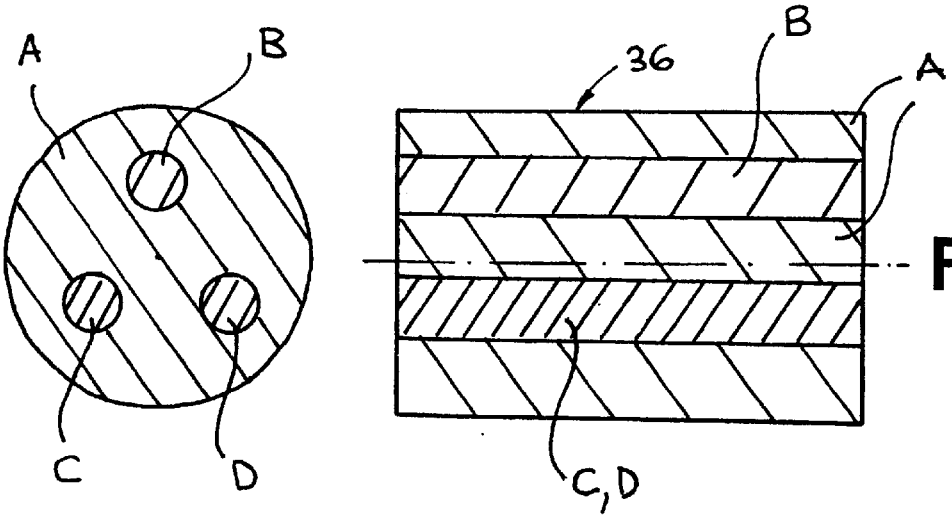

Various preforms 36 with cross-sectionally different material regions A, B, C, D are shown by way of example in FIGS. 2 to 4. It will be immediately clear that profiles with cross-sectionally different material properties can be produced with these preforms. A temperature profile cross-sectionally adapted to the respective material regions within the heating means 42 can ensure that a uniform solid/liquid ratio is set in all of the material regions A, B, C, D at the outlet of the heating means 42.

The preforms 36 can essentially be supplied to the preform chamber 12 already in the partially solid/partially liquid state. However, in view of the fact that it is easier to manipulate perfectly rigid preforms, the latter are usually heated to just below the respective lowest solidus temperature and are only converted to the desired partially solid/partially liquid state once they are inside the preform chamber 12 and the forming chamber 14.

In the following tables, the values for the pressure p and the degree of shaping d determined for one possible arrangement by way of a model calculation are associated with the individual shaping stations of the arrangement according to the invention.

| | preform chamber | forming chamber | mould | die |
|---|---|---|---|---|
| p (bar) | 100 | 500 | 100 | 1000 |
| d (%) | 0 | 90 | 2 | 8 |

Figure 5:
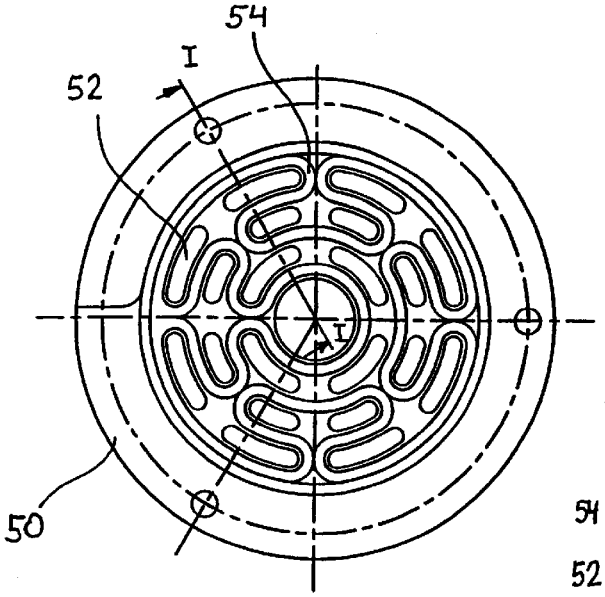
FIG. 5 is a top view of a disc-shaped heating element.
Figure 7:
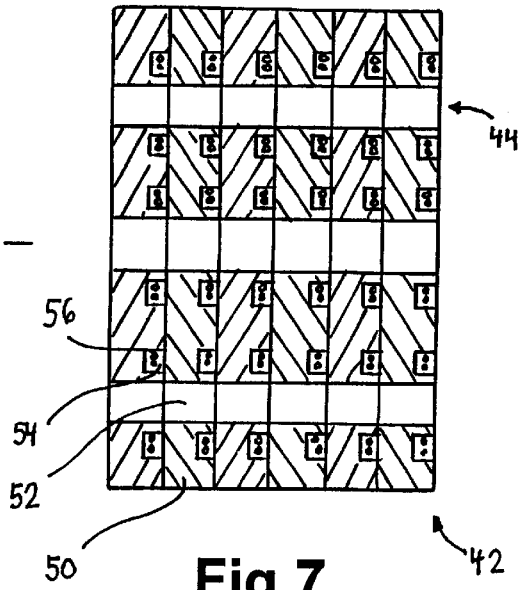
FIG. 7 is a longitudinal section through a heating means with heating elements.
Figure 6:
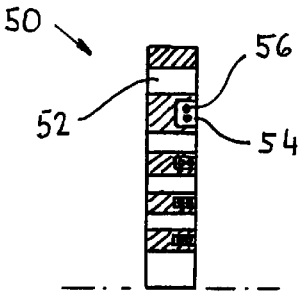
FIG. 6 is a partial cross section through the heating element of FIG. 5 along the line of I—I thereof.

According to FIGS. 5 to 7, the heating means 42 is composed of individual disc-shaped heating elements 50. These heating elements 50 made, e.g. of steel, have openings 52 surrounded by grooves 54 worked into the surface. After the insertion of heating wires 56, the grooves 54 are closed by welding. FIG. 7 shows the alignment of disc-shaped heating elements 50 relative to the heating means 42. The openings 52 in the individual disc-shaped heating elements 50 are adapted to one another in such a manner that they form the through flow channels 44.

Figure 8:
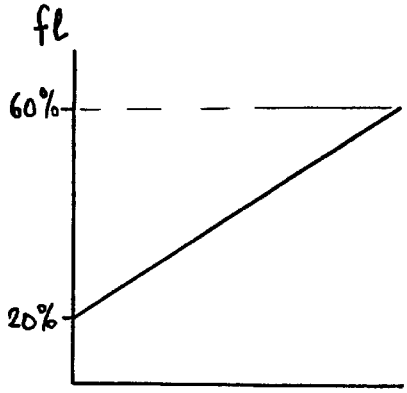
FIG. 8 is a temperature profile over the length of the heating means of FIG. 7.

FIG. 8 shows the percentage liquid fraction of the material to be processed over the length of the heating means 42 of FIG. 7. A temperature profile leading to a substantially linear increase in the liquid phase fraction is produced by individual control of the individual heating elements 50. When the material to be processed enters the heating means 42, the liquid phase fraction is, e.g. 20%, and at the outlet end of the heating means it is, e.g. 60%. In the case of a heating capacity of approximately 1 kW per heating element, 5 to 6 elements are sufficient to produce the desired liquid phase fraction.

Figure 9:
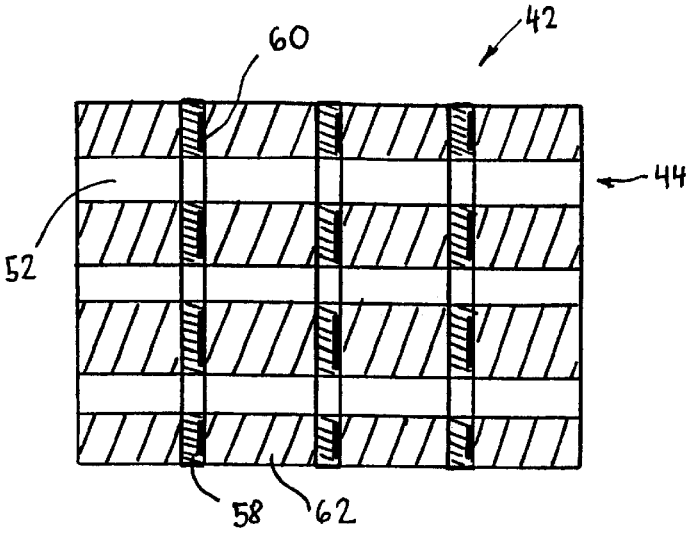
FIG. 9 shows another embodiment of a heating means with heating elements.

FIG. 9 shows an alternative embodiment of the heating means 42. Disc-shaped heating elements 58, e.g. of boron nitride have heating conductors 60 integrated into their surface. The thickness of the heating elements 58 is, e.g. 1 mm. The individual heating elements 58 are separated from one another by intermediate discs 62, e.g. of carbon fibre-reinforced graphite. The heating elements 58 and the intermediate discs 62 have openings 52 which in their entirety form the flow channels 44. A heating means of this kind can be operated at temperatures in excess of 1000° so that the liquid phase fraction can already be set to approximately 20% by reflecting heat into the preform 36 before it enters the heating means 42. In addition, a desired temperature profile can be set substantially more rapidly and more precisely by this means.

What is claimed is:

1. A process for manufacturing a shaped bar from a partially solid/partially liquid preform including an at least partially metallic material, comprising the steps of:

initially guiding the preform through a plurality of heatable parallel flow channels of a heating zone for heating the preform and setting the preform to a uniform solid/liquid ratio over an entire cross-section of the shaped bar in the heating zone;

pressing the preform in the partially solid/partially liquid state through a shaping opening to form the shaped bar; and guiding the shaped bar in the partially solid/partially liquid state through an open-ended chilled mold for solidification.

2. A process according to claim 1, wherein the shaping step includes pressing the preform to form the shaped bar using a tensile force acting on the shaped bar.

3. A process according to claim 1, wherein the shaping step includes shaping the preform by at least 50%.

4. A process according to claim 3, wherein the shaping step includes shaping the preform by at least 80%.

5. A process according to claim 1, and further comprising the step of final shaping a cross-section of the shaped bar in a die immediately after the shaped bar emerges from the mold.

6. A process according to claim 5, wherein the step of final shaping of the cross-section of the shaped bar includes shaping of no more than 15%.

7. A process according to claim 6, wherein the final shaping step includes shaping of no more than 10%.

8. A process according to claim 1, and further comprising the step of cooling the shaped bar after it emerges from the mold by complete evaporation of a coolant sprayed onto the shaped bar.

9. A process according to claim 5, and further comprising the step of cooling the shaped bar after it emerges from the die by complete evaporation of a coolant sprayed onto the shaped bar.

10. A process according to claim 1, wherein the shaping step includes shaping the preform with a liquid phase fraction of at most 70%.

11. A process according to claim 10, wherein the shaping step includes shaping the preform with a liquid phase fraction of 20 to 50%.

12. A process according to claim 1, wherein the preform includes a thixotropic alloy.

13. A process according to claim 12, wherein the preform includes one of a thixotropic aluminium alloy and a thixotropic magnesium alloy.

14. A process according to claim 1, wherein the preform is a non-thixotropic hard alloy of one of aluminium and magnesium.

15. A process according to claim 14, wherein the preform is one of an AlMg alloy and an MgAl alloy.

16. A process according to claim 1, wherein the preform is one of a reinforced aluminium material and a reinforced magnesium material, and reinforced material being one of particle-reinforced and fiber-reinforced.

17. A process according to claim 1, wherein the preform is composed of cross-sectionally different material regions.

18. A process according to claim 1, and further comprising the step of adding a filler material to the preform in the partially solid/partially liquid state before it enters the mold.

19. A process according to claim 18, wherein the step of adding filler material includes adding the filler material in solid form as one of wire, fibers and powder.

20. A process according to claim 18, wherein the step of adding filler material includes adding a liquid filler material.

21. A process according to claim 18, wherein the step of adding filler material includes adding a gaseous filler material.

22. A process according to claim 1, wherein the preform is composed of cross-sectionally different material regions and the step of guiding the preform through a heating zone includes setting a cross-sectionally different temperature profile in the preform in the heating zone as a function of the cross-sectionally different material regions.

23. A device for manufacturing a shaped bar from a preform of at least partially metallic material, comprising:

a heatable preform chamber for receiving the preform;

a heatable forming chamber connected to the preform chamber for shaping the preform in a partially solid/partially liquid state to form the shaped bar;

an open-ended chilled mold connected to the forming chamber for solidifying the shaped bar; and heating means having a plurality of heatable parallel flow channels for heating the preform, the heating means being arranged between the preform chamber and the forming chamber.

24. A device according to claim 23, and further comprising extractor means arranged downstream of the shaped bar for applying a tensile force thereto.

25. A device according to claim 23, and further comprising die means arranged immediately downstream of the mold for final shaping a cross-section of the shaped bar.

26. A device according to claim 23, wherein the forming chamber has a wall that passes over into a wall of the mold with a constant curvature.

27. A device according to claim 23, and further comprising heating lines arranged in at least one of the preform chamber and the forming chamber.

28. A device according to claim 23, and further comprising an intermediate wall of a heat-insulating material arranged between the forming chamber and the mold.

29. A device according to claim 24, wherein the flow channels are individually heatable.

30. A device according to claim 29, wherein the heating means includes at least two disc-shaped heating elements arranged side by side and provided with integrated heating conductors, the heating elements being individually controllable.

31. A device according to claim 23, and further comprising direct cooling means for further cooling of the shaped bar emerging from the mold.

32. A device according to claim 31, wherein the direct cooling means is operative to apply coolant to the shaped bar to an extent sufficient to obtain complete evaporation of the coolant.

33. A device according to claim 25, and further comprising direct cooling means for further cooling of the shaped bar emerging from the die means.

* * * * *